US006868559B1

(12) United States Patent
Wong

(10) Patent No.: US 6,868,559 B1
(45) Date of Patent: Mar. 22, 2005

(54) MULTI-SIZE CAP

(76) Inventor: Cham Chung Wong, 2311 West 23rd Avenue, Vancouver, British Columbia (CA), V6L 1N5

( * ) Notice: Subject to any disclaimer, the term of this patent is extended or adjusted under 35 U.S.C. 154(b) by 0 days.

(21) Appl. No.: 10/851,104

(22) Filed: May 24, 2004

(51) Int. Cl.[7] ..... A42B 1/00
(52) U.S. Cl. ..... 2/195.3; 2/209.12
(58) Field of Search ..... 2/181.5, 181, 183, 2/195.1

(56) References Cited

U.S. PATENT DOCUMENTS 5,615,415 A 4/1997 Beckerman
5,715,540 A 2/1998 Cho
5,966,742 A 10/1999 Cunliffe
5,983,398 A * 11/1999 Kronenberger ..... 2/181
6,122,774 A 9/2000 Park
6,131,202 A 10/2000 Yan

FOREIGN PATENT DOCUMENTS

WO WO 01/05259 A1 1/2001

* cited by examiner

*Primary Examiner*—John J. Calvert
*Assistant Examiner*—Andrew W. Sutton
(74) *Attorney, Agent, or Firm*—Stephen R. Burri; Miller Thomson LLP

(57) ABSTRACT

A multi-size cap comprises a crown portion having a plurality stretchable gores, a double-layer, seamless headband composed of a stretchable material connected to the peripheral edge of the crown portion, and an elastic band external to the headband extending the entire length of the lower peripheral edge along the inside surface of the crown portion. The cap is adaptable to comfortably and securely fit a variety of head sizes.

13 Claims, 2 Drawing Sheets

MULTI-SIZE CAP

TECHNICAL FIELD OF THE INVENTION

The present invention relates generally to caps to be worn on the head of the user, and more particularly to a multi-size cap for wearing on a variety of head sizes.

BACKGROUND OF THE INVENTION

It is known to provide a cap which is adapted to fit a variety of head sizes. In particular, it is known to provide a cap which uses a stretchable headband to accommodate a variety of head sizes.

Examples of such caps include the caps described in PCT Application No. PCT/AU00/00847 entitled "Cap with Stretchable Band" to Higgs ("Higgs"), U.S. Pat. No. 6,122,774 entitled "Free Size Cap" to Park ("Park"); U.S. Pat. No. 6,131,202 entitled "Multi-axially Stretchable Fabric Cap" to Yan ("Yan"); U.S. Pat. No. 5,615,415 entitled "Custom Fit Cap" to Beckerman ("Beckerman"); U.S. Pat. No. 5,715,540 entitled "Free-Size Cap" to Cho ("Cho") and U.S. Pat. No. 5,966,742 entitled "Adjustable Cap" to Cunliffe ("Cunliffe").

There are a number of desirable objectives in relation to a multi-size cap. Such a cap should ideally provide stretching of at least the rearmost gores of the crown portion and of the headband. Preferably, the stretching of the crown will be similar to the stretching of the headband. Ideally, the headband should be multi-layered and porous. The headband preferably should present an even surface for comfortable contact with the users head. The headband preferably should cover the entire circumference of the cap.

Existing caps achieve some of these objectives, but with varying degrees of success. For example, Higgs describes a cap with a headband which incorporates an elastic band, thereby reducing the smoothness of the headband. Higgs also describes a napped headband which absorbs liquids well but is not porous.

Park teaches a cap in which the headband extends along only a front portion of the circumference of the crown, and the headband incorporates a sponge material rather than an elastic band. Yan describes a cap which uses a foam band rather than an elastic band, and which has only a single layered headband.

In Beckerman, Cho and Cunliffe the headband is a single layer, and there is no use of an elastic band. Cunliffe teaches a headband which extends along only a portion of the circumference of the crown portion of the cap.

It is an object of the present invention to provide a cap of simple construction which will fit a variety of head sizes and is comfortable to wear.

SUMMARY OF THE INVENTION

According to one embodiment of the present invention, there is provided a cap comprising a crown portion with a forward end, a rearward end and a lower peripheral edge, wherein at least the rearward end is composed of a stretchable material aligned to stretch in at least a peripheral direction; a headband composed of a stretchable material aligned to stretch in at least a peripheral direction and having upper and lower edges, the lower edge connected to the peripheral edge of the crown portion; and an elastic band external to the headband extending the entire length of the lower peripheral edge along the inside surface of the crown portion.

In another embodiment, the crown portion may comprise a plurality of generally triangular gores of which at least one of the rearward gores may be composed of a stretchable material.

In one embodiment, the headband may comprise at least two layers of a stretchable material, and be seamless along its entire length.

In another embodiment, the headband may be tacked at several positions to the inside surface of the crown portion, and the headband extends along the entire length of the lower peripheral edge.

In a further embodiment the stretchable material of the headband is permeable, and may be woven. The material may be a composite of cotton, latex and nylon.

In one embodiment, there are six gores of equal shape and size. The four rearward gores are composed of a stretchable material aligned to stretch in at least a peripheral direction.

In still another embodiment, there is a ventilation opening at a central position on at least one gore.

In another embodiment a rigid visor extends outwardly from the forward end of the crown portion of the main body of the cap at the lower peripheral edge.

Other aspects of the invention will be appreciated by reference to the description of the preferred embodiment which follows, and to the claims.

BRIEF DESCRIPTION OF THE DRAWINGS

The invention will be described by reference to the preferred embodiment and the drawings thereof in which.

DETAILED DESCRIPTION OF BEST MODE AND PREFERRED EMBODIMENT OF THE INVENTION

Figure 1:
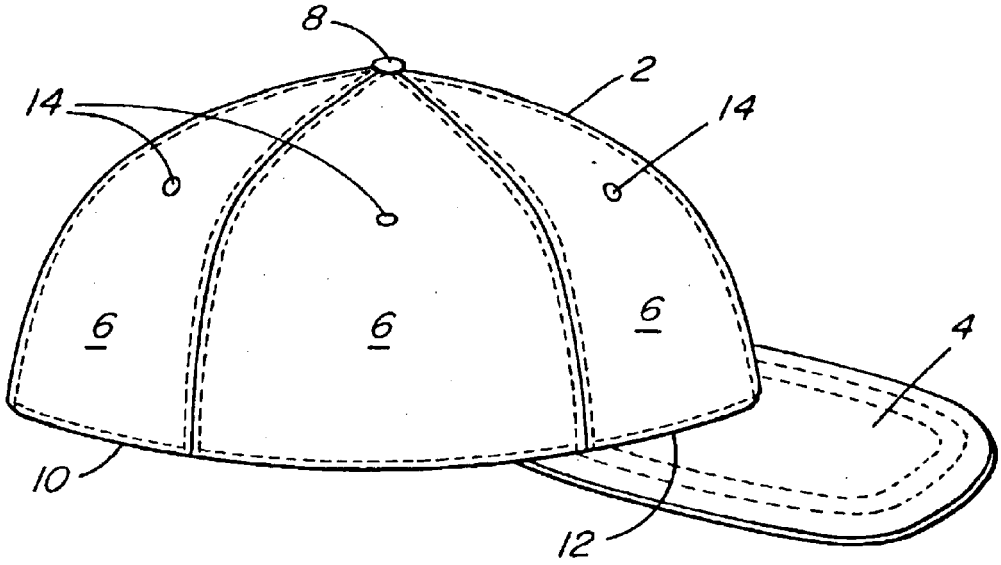
FIG. 1 is a perspective top view of the cap according to the invention.

As shown in FIG. 1, there is provided a cap having a crown portion 2 and a visor 4. The crown portion 2 is comprised of six generally triangularly shaped gores 6, three of which are shown in FIG. 1. Each gore 6 is joined by stitching or other means of attachment to the gore adjacent each side to form an apex 8 of the crown portion 2 and a circumference 10 of the crown portion 2. The visor 4 attached to the crown portion 2 along a front portion 12 of the circumference 10. Ventilation openings 14 preferably are positioned centrally in each gore to permit egress of heat and moisture.

Figure 2:
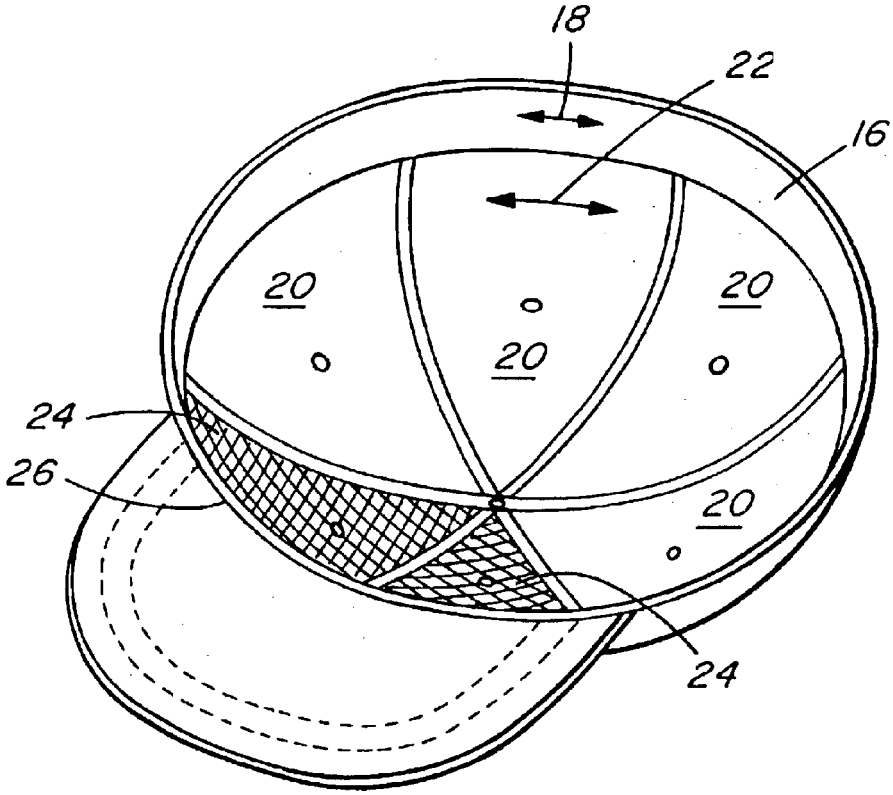
FIG. 2 is a perspective bottom view of the cap according to the invention.

Referring now to FIG. 2, a bottom view of the cap of the invention is shown. A stretchable headband 16 extends along the entire length of the circumference 10. The stretchable material is aligned to permit stretching primarily in the longitudinal direction, as indicated by arrow 18. The four rearmost gores 20 are composed of a stretchable material which may be the same material as the headband material. The material is aligned to permit stretching primarily in the longitudinal direction, as indicated by arrow 22. The two foremost gores 24 are composed of a material which is non-stretchable, to provide a visor attachment region 26 of uniform length.

Figure 3:
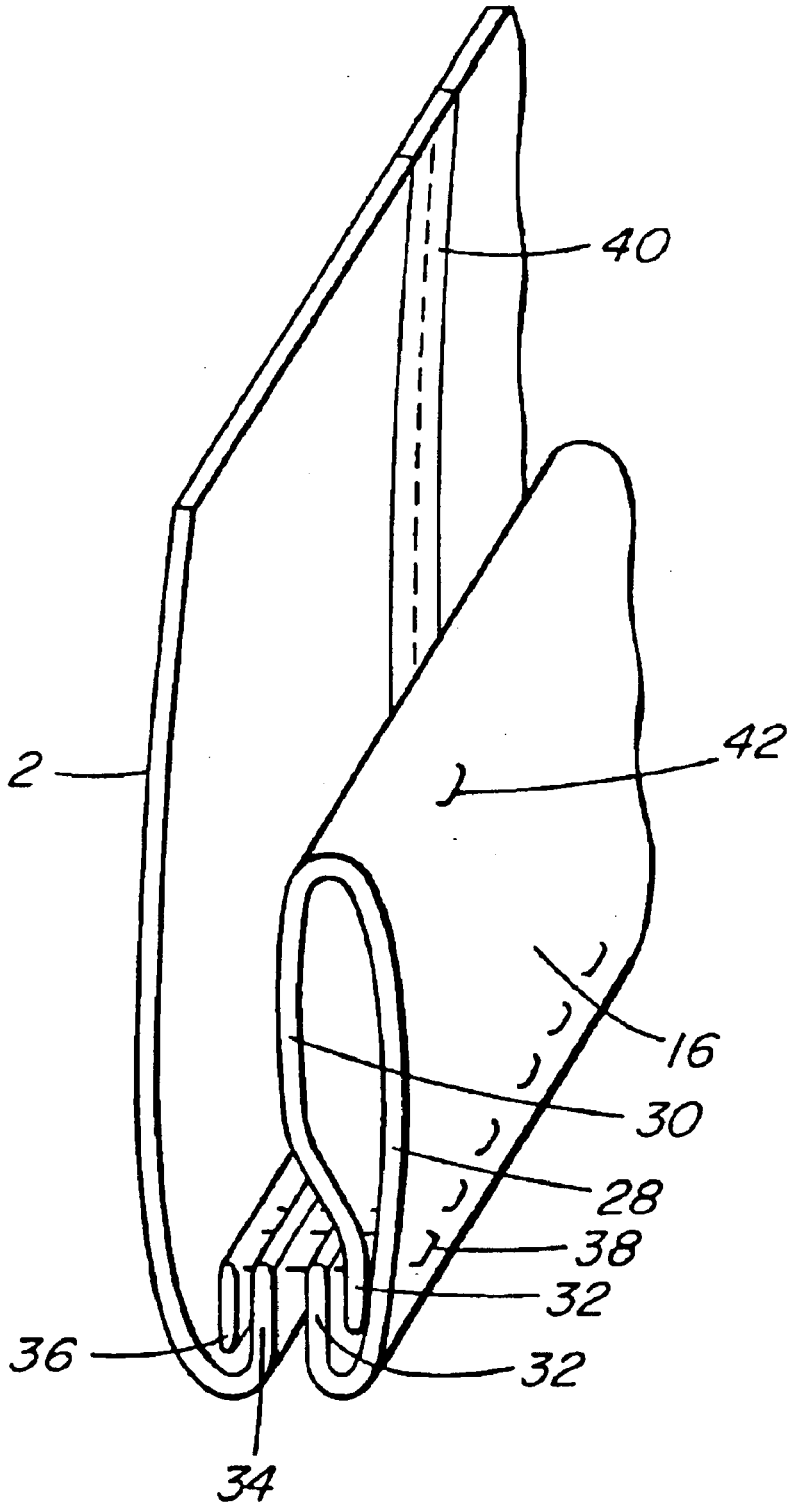
FIG. 3 is a cutaway view of the headband and elastic band arrangement according to the invention.

As shown in FIG. 3, the headband 16 is formed in a loop to provide inner 28 and outer 30 headband layers. The edges 32 of the headband loop are attached to an inward fold 34 of the gores 6 and to an elastic band 36 by stitching 38 or other means of attachment. The headband is preferably tacked to the crown portion at each seam 40 between adjacent gores by stitching or other attachment means 42.

The incorporation in the gores and the headband of a material which is aligned to stretch elastically in the longitudinal direction results in a cap crown portion which can stretch to comfortably fit heads of a wide variety of diameters. The present invention preferably uses the same material for the rearmost gores and for the headband, thereby reducing material and manufacturing costs. In the preferred embodiment, the material of the headband and stretchable rearmost gores is a composite of cotton, latex and nylon, but various other materials are possible.

To ensure a snug fit, the cap of the present invention incorporates a separate elastic band between the headband and the crown portion. The elastic band exerts even inward pressure on the users head to ensure the cap remains in place. In some multi-size caps, placement of elastic bands along only a portion of the periphery of the crown portion edge can result in uneven pressure on the head of the user. Points of differing pressure along the headband are avoided by locating the elastic band separate from and external to the headband.

As best seen in the headband and elastic band arrangement shown in FIG. 3, there are several layers of fabric between the elastic band and the interior of the crown portion where the user's head would be positioned. In addition to the two layers of the headband loop, there is an inward fold of the gore material. This triple layer of material reduces discomfort which might otherwise occur from the pressure of the elastic band on the head of the user. In some prior art caps, the elastic band is arranged internal to the headband, or within a two-layer headband. Either such prior art arrangement is likely to offer less intervening material between the elastic and the user's head, therefore offering less comfort.

For ease of manufacture and optimization of materials and costs, a single stitching pass is used to assemble the headband loop, create the inward fold of the gores, and attach the elastic band and headband loop to the crown portion. The cap is preferably manufactured with a knitting machine, but other means of manufacture are also possible.

The headband material is preferably of a woven construction, creating a porous product. Rather than absorb and collect moisture, this porous construction allows heat and moisture to pass freely away from the user's head for increased comfort.

The headband loop is formed as a single piece of material about the entire circumference. As such, there are no transverse seams present on the headband. Such seams can cause uneven pressure and discomfort for the user.

While the preferred method of attachment of the gores to one another and of the headband and elastic band to the gores is stitching, other means of attachment are possible and are within the scope of the present invention.

While the preferred embodiment of the present invention comprises a visor portion, other embodiments without a visor are also understood to be within the scope of the invention.

It will be appreciated by those skilled in the art that other variations of the preferred embodiment may also be practiced without departing from the scope of the invention.

What is claimed is:

1. A cap comprising a crown portion with a forward end, a rearward end and a lower peripheral edge, wherein at least the rearward end of the crown portion is composed of a stretchable material aligned to stretch in at least a peripheral direction;

a headband composed of a stretchable material aligned to stretch in at least a peripheral direction and having upper and lower edges, the lower edge connected to the peripheral edge of the crown portion; and an elastic band external to the headband extending the entire length of the lower peripheral edge along the inside surface of the crown portion.

2. The cap of claim 1 wherein the crown portion further comprises a plurality of generally triangular gores, wherein at least one of the gores adjacent the rearward end is composed of a stretchable material aligned to stretch in at least a peripheral direction.

3. The cap of claim 1 wherein the headband comprises at least two layers of a stretchable material.

4. The cap of claim 3 wherein the headband is seamless along its entire length.

5. The cap of claim 1 wherein the headband is tacked at several positions to the inside surface of the crown portion.

6. The cap of claim 1 wherein the upper edge of the headband extends along the entire length of the lower peripheral edge.

7. The cap of claim 3 wherein the stretchable material is permeable.

8. The cap of claim 3 wherein the stretchable material is woven.

9. The cap of claim 2 wherein the plurality of gores comprises six gores of equal shape and size.

10. The cap of claim 9 wherein the four gores adjacent the rearward end are composed of a stretchable material aligned to stretch in at least a peripheral direction.

11. The cap of claim 1 wherein the stretchable material of the headband is a composite of cotton, latex and nylon.

12. The cap of claim 2 further comprising a ventilation opening at a central position on at least one gore.

13. The cap of claim 1 further comprising a rigid visor extending outwardly from the forward end of the crown portion at the lower peripheral edge.

* * * * *